US005127841A

United States Patent [19]

Bannai et al.

[11] Patent Number: 5,127,841

[45] Date of Patent: Jul. 7, 1992

[54] CLOCK SPRING

[75] Inventors: Hiroyuki Bannai, Furukawa; Hironori Kato, Sendai, both of Japan

[73] Assignee: Alps Electric Co., Ltd., Tokyo, Japan

[21] Appl. No.: 715,153

[22] Filed: Jun. 13, 1991

[30] Foreign Application Priority Data

Jun. 14, 1990 [JP] Japan ..... 2-26198[U]

[51] Int. Cl.[5] ..... H01R 35/00

[52] U.S. Cl. ..... 439/164; 439/15; 439/488

[58] Field of Search ..... 439/13, 15, 164, 488, 439/491

[56] References Cited

U.S. PATENT DOCUMENTS 4,789,342 12/1988 Shitanoki .
4,821,016 4/1989 Zeller et al. ..... 439/15 X
4,875,860 10/1989 Suzuki ..... 439/15
4,978,191 12/1990 Hasegawa et al. ..... 439/164 X

*Primary Examiner*—Eugene F. Desmond

*Attorney, Agent, or Firm*—Guy W. Shoup; B. Noel Kivlin

[57] ABSTRACT

A clock spring used with, e.g., a steering apparatus of a motor vehicle to establish electrical connection between a stationary member and a movable member by using cables. The clock spring has a stationary member, a movable member fitted to the stationary member so as to be rotatable relative to the same, and a cable having a portion accommodated in a cable housing defined by the stationary and movable members. Two end portions of the cable are respectively fixed to the stationary and movable members and are led out of the cable housing. An improvement achieved by the invention resides in that the portion of the cable accommodated in the cable housing consists of a portion coiled on the stationary member, a portion coiled on the movable member in the direction opposite to the direction of coiling in the stationary member, and a turned portion connecting the coiled portions, and that a rolling member is provided which is pinched between the stationary and movable members and which serves as an indicator.

3 Claims, 6 Drawing Sheets

CLOCK SPRING

BACKGROUND OF THE INVENTION

This invention relates to a clock spring used with, for example, a steering apparatus of a motor vehicle to establish electrical connection between a stationary member and a movable member by using cables.

A clock spring is a device for connecting a stationary member and a movable member rotatably fitted to the stationary member through a cable. For example, clock springs of this kind have been used as electrical connection devices for steering apparatuses of motor vehicles.

A type of conventional clock spring is known which has a flat cable having a plurality of threads of conductors sandwiched in a pair of laminated band-like films. The flat cable is loosely accommodated in a coiled state in a cable housing provided between a stationary member and a movable member. One end of the flat cable is fixed to an outer cylindrical wall formed on one of the stationary and movable members, and the other end is fixed to an inner cylindrical wall formed on the other of the stationary and movable members.

In this clock spring, when the movable member is rotated, the flat cable accommodated in the cable housing can wrap round the inner cylindrical wall or unwrap toward the outer cylindrical wall according to the direction of rotation of the movable member. No substantial tensile force is applied to the flat cable in a range between the state in which the flat cable is fully wrapped round the inner cylindrical wall and the state in which it is fully unwrapped toward the outer cylindrical wall. It is thereby possible to constantly maintain the electrical connection between the stationary and movable members rotated relative to each other.

At the time of assembly of the thus-constructed clock spring on a steering apparatus, it is necessary to assemble the clock spring in such a manner as to set the same extents of clockwise and counterclockwise rotations of the movable member from a neutral position. A positioning mechanism has therefore been proposed which has an indicator gear axially supported on the stationary member, and a projection provided on the movable member so as to be engagable with the gear, and in which the gear is rotated by a predetermined angle when the movable member makes one revolution, thereby enabling positioning between the movable and stationary members. In this conventional positioning mechanism, however, it is necessary for the gear to be placed outside the outer cylindrical wall of the stationary member, and the outside diametrical size of the clock spring is thereby increased.

In the above-described clock spring, since the flat cable is coiled or uncoiled by utilizing the difference between the diameters of the outer and inner cylindrical walls, the length of the flat cable to be used can be reduced if the difference between these diameters is increased, provided that the extents of rotation of the movable member are constant. However, the diameter of the inner cylindrical wall is determined by the diameter of a rotating shaft to which the clock spring is to be attached, e.g., the steering shaft of a vehicle, while the diameter of the outer cylindrical wall cannot be increased substantially, because it is desirable to reduce the overall size of the device. The difference between the diameters of the outer and inner cylindrical walls is therefore limited. Consequently, a very long flat cable is generally required for this kind of clock spring, and the total cost of the clock spring is increased because there is a difficulty in manufacturing such a long flat cable as is well known.

SUMMARY OF THE INVENTION

The present invention has been achieved in consideration of these circumstances, and an object of the present invention is to provide a small low-cost clock spring.

To achieve this object, according to the present invention, there is provided a clock spring comprising a stationary member, a movable member fitted to the stationary member so as to be rotatable relative to same, at least one cable having a portion accommodated in a cable housing defined by the stationary and movable members and two end portions respectively fixed to the stationary and movable members and led out of the cable housing, the portion of the cable accommodated in the cable housing including a portion coiled in the stationary member, a portion coiled on the movable member in the direction opposite to the direction of coiling on the stationary member, and a turned portion connecting the coiled portions, and a rolling member pinched between the stationary and movable members, the rolling member serving as an indicator.

When the movable member is rotated relative to the stationary member, the rolling member interposed therebetween and serving as an indicator revolves in the same direction as the movable member to an extent corresponding to half of the extent of rotation of the movable member while rotating on its axis. It is possible to position the movable and stationary members relative to each other by observing an indication mark provided on the rolling member.

By the revolution of the movable member, the turned portion of the cable revolves generally at the same speed as the rotational speed of the rolling member so that the portion of the cable coiled in one of the movable and stationary members is uncoiled to be coiled in the other.

BRIEF DESCRIPTION OF THE DRAWINGS

FIG. 1 is a schematic perspective view of the construction of the clock spring;

FIG. 2 is an exploded perspective view;

FIG. 3 is a plan view;

FIG. 4 is a longitudinal sectional view;

FIG. 5 is a bottom view of the upper case;

FIG. 6 is a perspective view showing a housed state of the gear;

FIGS. 7(*a*), 7(*b*), and 7(*c*) are diagrams of the movement of a flexible cable;

FIGS. 8(*a*) and 8(*b*) are diagrams of the operation of the gear; and

DESCRIPTION OF THE PREFERRED EMBODIMENTS

Figure 1:
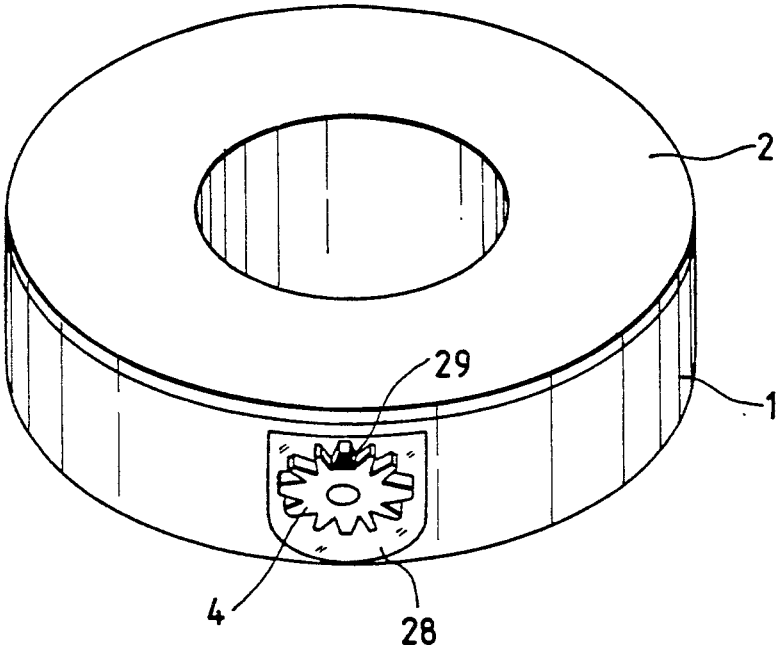
FIGS. 1 to 8 are diagrams of a clock spring in accordance with a first embodiment of the present invention.

Embodiments of the present invention will be described below with reference to the accompanying drawings.

Referring to FIGS. 1 to 4, the clock spring is mainly constituted by a lower case 1, an upper case 2 supported on the lower case 1 so as to be rotatable relative to the same, a spacer 3 rotatably interposed between the two cases 1 and 2, a gear 4 for rotatingly driving the spacer 3, and flexible cables 5 coiled in the two cases 1 and 2.

The lower case 1 has a bottom plate 7 in which a central opening 6 is formed and inner and outer circumferential walls 8 and 9 perpendicularly extending from the inner and outer circumferential ends of the bottom plate 7. The lower case 1 has a cylindrical shape generally opened at its top and closed at its bottom. A plurality of threads of projections 10 are formed on the bottom plate 7 concentrically with the central opening 6 so as to extend perpendicularly from the bottom plate 7. A plurality (five threads in this embodiment) of first cable accommodation grooves 11 are formed between the projections 10. Cable outlet holes (not shown) are formed in portions of the bottom plate 7 corresponding to the bottoms of the first cable accommodation grooves 11. A first rack 12 which meshes with the gear 4 described later is formed on the bottom plate 7 at a position between the outermost projection 10 and the outer circumference wall 9 so as to have a ring-like shape as viewed in plan. A window hole 27 is formed in the outer circumferential wall 9, and a transparent cover 28 is fitted in the window hole 27.

Figure 5:
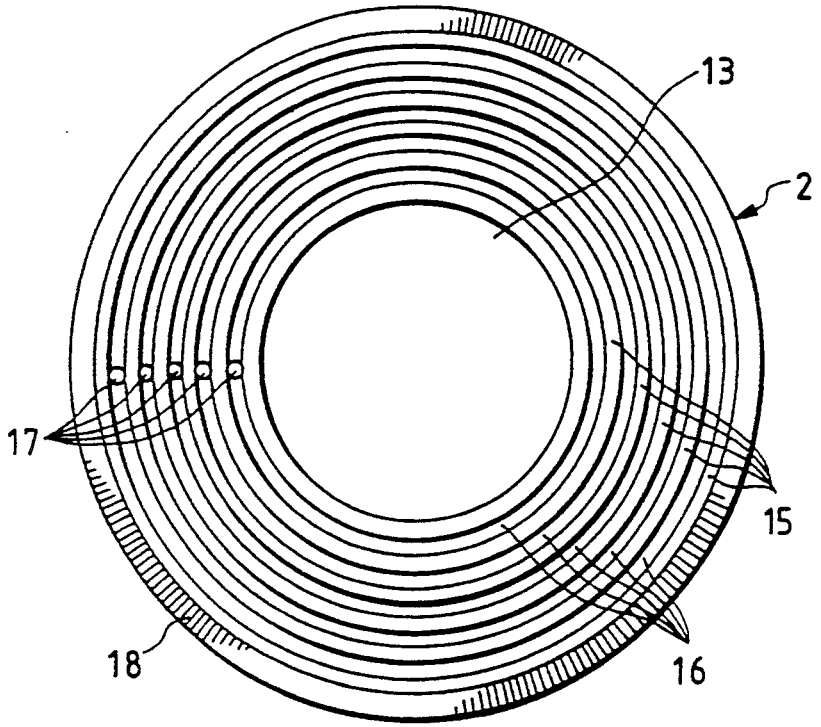

As shown in FIG. 5, the upper case 2 has a ceiling plate 14 having a central opening 13 and is rotatably connected to the lower case 1 by being fitted around internal surfaces of the inner circumferential wall 8 in a snap connection manner. A plurality of threads of projections 15 are formed on the ceiling plate 14 concentrically with the central opening 13 so as to extend perpendicularly from the ceiling plate 14. A plurality (five threads in this embodiment) of second cable accommodation grooves 16 are formed between the projections 15. The second cable accommodation grooves 16 and the first cable accommodation grooves 11 face each other with the later-described spacer 3 interposed therebetween. Cable outlet holes 17 are also formed in portions of the ceiling plate 14 corresponding to the bottoms of the second cable accommodation grooves 16. A second rack 18 having a ring-like shape as viewed in plan is formed on a circumferential portion of the ceiling plate 14. The gear 4 also meshes with the second rack 18.

Figure 6:
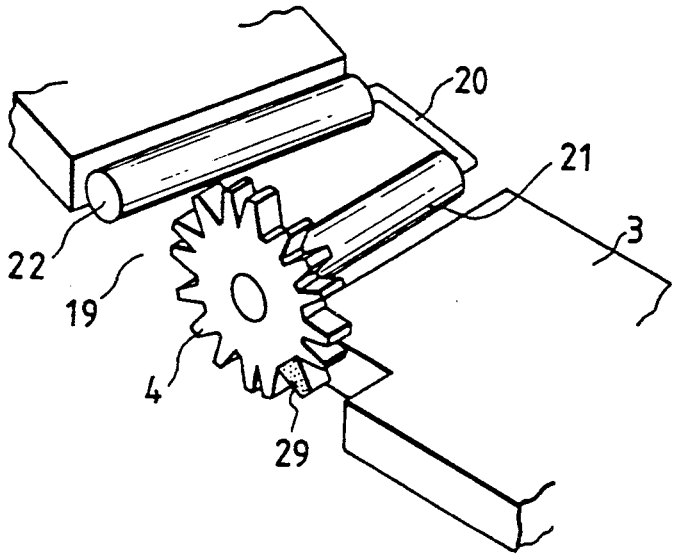

The spacer 3 is formed of a material such as a molded synthetic resin having a good sliding property, and has a generally ring-like shape with a cut opening 19. The spacer 3 is rotatably interposed between the first cable accommodation grooves 11 of the lower case 1 and the second cable accommodation grooves 16 of the upper case 2. As shown in FIG. 6, a shaft member 20 having two arm portions is set in the opening 19, and a first roller 21 and a second roller 22 are respectively supported axially on the arms of the shaft member 20 so as to be freely rotatable. The gear 4 is fixed to one end of the first roller 21 by press fitting. As mentioned above, the gear 4 meshes with the first and second racks 12 and 18. A mark 29 indicating a reference point for positioning is provided on a surface of the gear 4.

Figure 4:
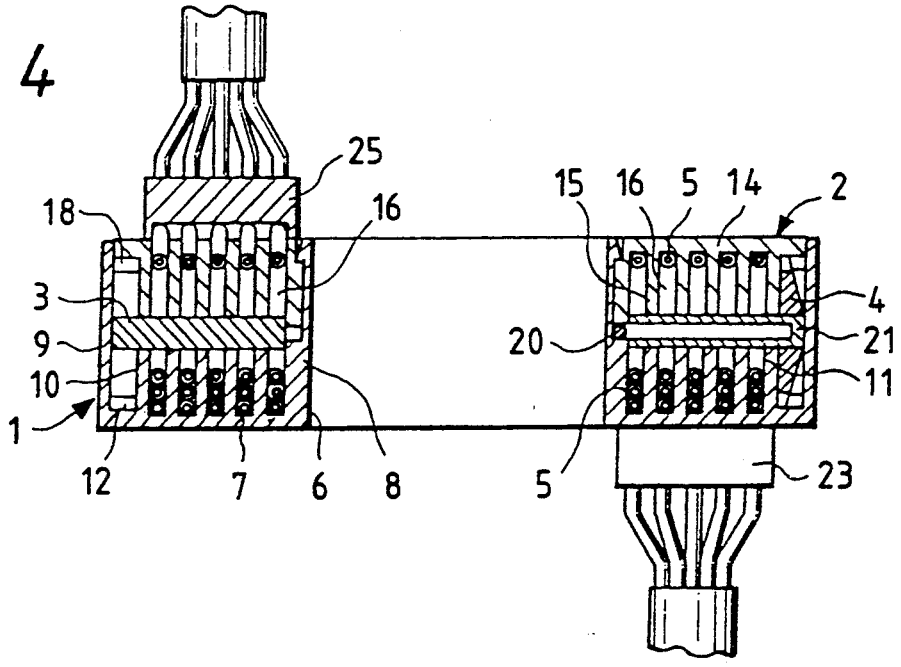

The flexible cables 5 are formed of cables called wire harness, i.e., conductor wires covered with an insulating material. In this embodiment, five wire harness cables are used. FIG. 4 shows a state in which flexible cables 5 are coiled in the first cable accommodation grooves 11 of the lower case 1. That is, one end of each flexible cable 5 extending from the upper case 2 into the lower case 1 through the opening 19 while being turned at the second roller 22 through about a half round is accommodated in the corresponding first cable accommodation groove 11 of the lower case 1, while the other end is coiled in the opposed second cable accommodation groove 16 of the upper case 2. One end of each flexible cable 5 is led through the unillustrated cable outlet hole to the outside of the lower case 1, is fixed by being cranked in a holder 23 attached to the lower surface of the bottom plate 7 of the lower case 1 and is connected to a lower connector 24 while being combined with the ends of the other cables 5. The other end of each flexible cable 5 is led through the cable outlet hole 17 to the outside of the upper case 2, is fixed by being cranked in a holder 25 attached to the upper surface of the ceiling plate 14 of the upper case 2 and is connected to an upper connector 26 while being combined with the ends of the other cables 5.

Figure 7A:
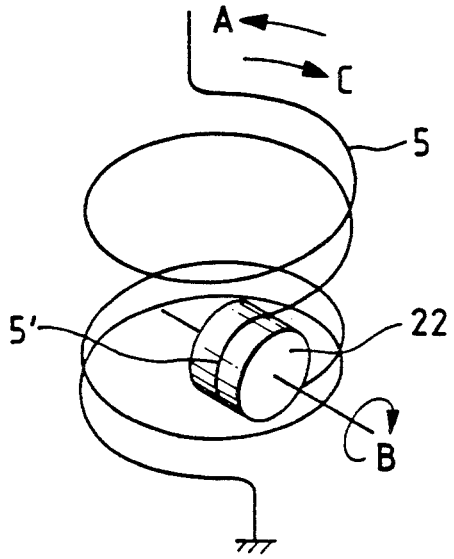
Figure 7B:
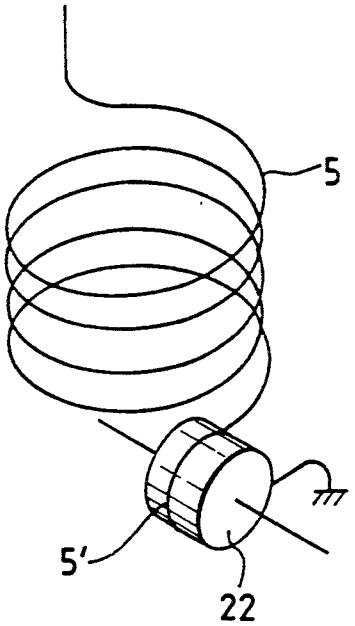
Figure 7C:
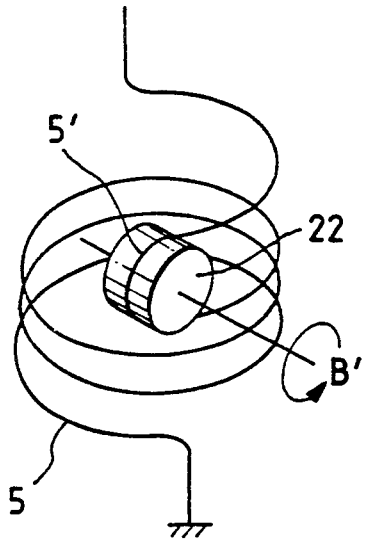

Next, the operation of the clock spring in accordance with the above-described embodiment will be described below with respect to a case in which the lower case 1 is used as a stationary member while the upper case 2 is used as a movable member. In FIGS. 7(*a*) to 7(*c*), one of the flexible cables 5 is illustrated schematically while the lower and upper cases 1 and 2, the spacer 3 and other members are omitted.

Figure 8A:
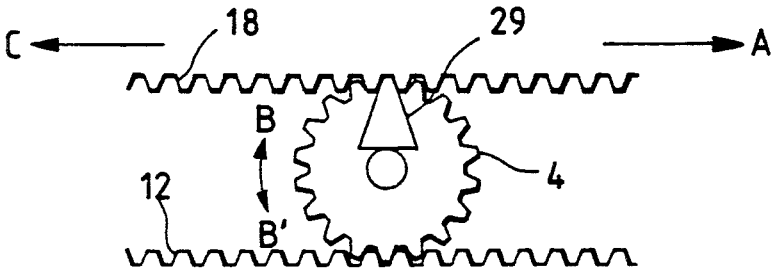
Figure 8B:
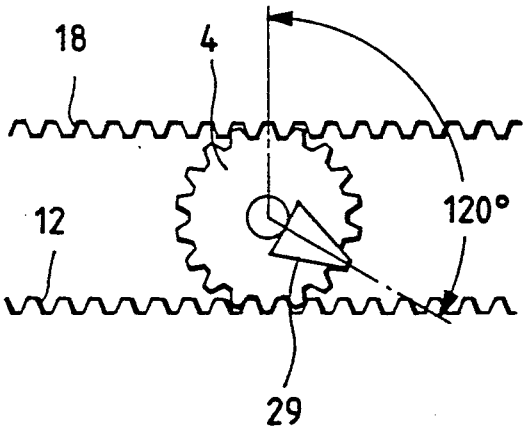

FIG. 7(*a*) shows a neutral state in which the amounts of coiling of the flexible cable 5 in the first cable accommodation groove 11 of the lower case 1 and the second accommodation groove 16 of the upper case 2 are equal. In this case, the mark 29 of the gear 4 is located at right-above position as shown in FIG. 8(*a*), and the gear 4 can be seen from the outside through the cover 28.

When the upper case 2 is rotated counterclockwise (in the direction of arrow A in FIG. 7(*a*)) to a predetermined extent from the state shown in FIG. 7(*a*), the gear 4 meshing with the racks 12 and 18 of the lower and upper cases 1 and 2 revolves in the direction of arrow A to an extent corresponding to half the extent of rotation of the upper case 2 while rotating clockwise (in the direction of arrow B) on its axis, and the spacer 3 supporting the shaft of the gear 4 is driven by the gear 4 to rotate in the direction of arrow A to the same extent as the revolution of the gear 4. Also, the turned portion 5' of the flexible cable 5 wrapped round the second roller 22 is also moved in the direction of arrow A to the same extent as the spacer 3 (i.e., half the extent of rotation of the upper case 2), and a length of flexible cable 5 equal to the extent of this movement is payed out from the first cable accommodation groove 11 of the lower case 1 and is coiled in the second cable accommodation groove 16 of the upper case 2.

Thus, when the upper case 2 is rotated in the direction of arrow A to make N revolutions, the spacer 3, the gear 4 and the second roller 22 make N/2 revolutions, so that a length of flexible cable 5 corresponding to N/2 rounds is payed out from the first cable accommodation groove 11 through the opening 19 to be coiled in the second cable accommodation groove 16.

The upper case 2 can be rotated in the direction of arrow A until the whole of the flexible cable 5 coiled in the first accommodation groove 11 of the lower case 1 is coiled in the second cable accommodation groove 16 of the upper case 2, as shown in FIG. 7(*b*). That is, the upper case 2 can make revolutions twice as much as the number of windings of flexible cable 5 in the lower case 1. The counterclockwise rotation of the upper case 2 is terminated at the position corresponding to the state shown in FIG. 7(*b*).

When the upper case 2 is rotated reversely relative to the above rotation, that is, rotated clockwise (in the direction of arrow C) from the state shown in FIG. 7(*a*), the gear 4 revolves in the direction of arrow C to an extent corresponding to half the extent of rotation of the upper case 2 while rotating counterclockwise (in the direction of arrow B'), so that, as shown in FIG. 7(*c*), a length of flexible cable 5 equal to the extent of revolution of the gear 4 is payed out from the second cable accommodation groove 16 of the upper case 2 through the opening 19 to be coiled in the first cable accommodation groove 11 of the lower case 1.

If the number of teeth of the gear 4 is $Z_1$; the number of teeth of each of the racks 12 and 18 is $Z_2$; and the number of revolutions (rotational frequency) of the gear 4 during the period of time in which the gear 4 rolls on the racks 12 and 18 one round (revolves one time) is n, the relationship therebetween is:

$$Z_2 = n \times Z_1 \quad (1)$$

For example, $Z_1 = 18$ and $Z_2 = 96$ are set and are substituted in equation (1). Then, $$n = Z_2/Z_1 = 5\tfrac{1}{3}$$

is obtained. The gear 4 rotates $5\frac{1}{3}$ times during its one revolution.

In this case, therefore, when the upper case 2 is rotated counterclockwise (in the direction of arrow A) two times from the neutral position shown in FIG. 8(*a*), the gear 4 makes one revolution while rotating clockwise (in the direction of arrow B) $5\frac{1}{3}$ times, so that the mark 29 of the gear 4 is shifted clockwise by $\frac{1}{3}$ of one revolution, i.e., 120°, as shown in FIG. 8(*b*). When the upper case 2 is rotated clockwise (in the direction of arrow C) two times from the neutral position shown in FIG. 8(*a*), the gear 4 makes one revolution corresponding to half of the revolutions of the upper case 2 while rotating counterclockwise (in the direction of arrow B') $5\frac{1}{3}$ times, so that the mark 29 is shifted counterclockwise by 120°.

Thus, if the numbers of teeth $Z_1$ and $Z_2$ are set so that n in equation (1) is not a natural number, the mark 29 is shifted by a predetermined angle during the period of time in which the gear 4 makes one revolution. It is thereby possible to set the lower and upper cases 1 and 2 in a correct state (neutral state) with respect to the relative position therebetween in the direction of rotation. In the above-described embodiment, the setting of the clock spring is correct only when the state of the mark 29 at the tight-above position is seen through the cover 28. In other cases, i.e., a case in which the gear 4 is not seen through the cover 28 and a case in which the gear 4 is seen but the mark 29 is not at the right-above position, it is indicated that the setting of the clock spring is incorrect. In such cases, the upper case 2 may be rotated until the mark 29 is set to the right-above position to adjust the relative position of the lower and upper case 1 and 2.

In the above-described embodiment, only a length of flexible cable 5 may be provided such that each flexible cable 5 forms windings corresponding to about half the necessary amount of rotation may be provided. It is thus possible to greatly reduce the length of flexible cable 5 in comparison with the conventional device. Moreover, a wire harness can be used as flexible cable 5 to reduce the total cost of the clock spring. Since each flexible cable 5 used is short, the diameter of the cable housing can be reduced, which effect is advantageous in reducing the overall size of the clock spring.

The first and second cable accommodation grooves 11 and 16 concentrically formed in the opposed surfaces of the lower and upper cases 1 and 2 at equal pitches and the spacer 3 interposed between the cable accommodation grooves 11 and 16 prevent the flexible cables 5 from entangling with each other and also prevent each flexible cable 5 from entangling itself between the first and second cable accommodation grooves 11 and 16, thereby making it possible to smoothly coil and uncoil the flexible cables 5.

The shaft of the gear 4 is supported on the spacer 3, and the gear 4 is meshed with the ring-like racks 12 and 18 formed on the lower and upper cases 1 and 2, so that the spacer 3 can follow the movement of the turned portions 5' of the flexible cables 5. There is therefore no possibility of an excessive force being applied to the flexible cables. By this effect as well, the flexible cables 5 can be smoothly coiled and uncoiled.

The mark 29 is provided on the gear 4 to function as an indicator, whereby the lower and upper cases 1 and 2 can be positioned relative to each other by observing the gear 4 with the eye from the outside through the cover 28. Moreover, this positioning mechanism can be accommodated in the lower and upper cases 1 and 2. In this respect as well, the construction of the present invention is advantageous in reducing the size of the clock cable.

In the above-described embodiment, first and second cable accommodation grooves 11 and 16 are integrally formed on the lower and upper cases 1 and 2, respectively. Alternatively, projections 10 and 15 may be integrally formed on the upper and lower surfaces of the spacer 3 to provide the cable accommodation grooves 11 and 16 on the spacer 3, or only the cable accommodation grooves 11 or 16 may be provided on the spacer 3.

In the above-described embodiment, the lower case 1 is used as a stationary member while the upper case 2 is used as a movable member. However, the relationship between these members may be reversed; the upper case 2 may be used as a stationary member and the lower case 1 as a movable member.

Figure 9:
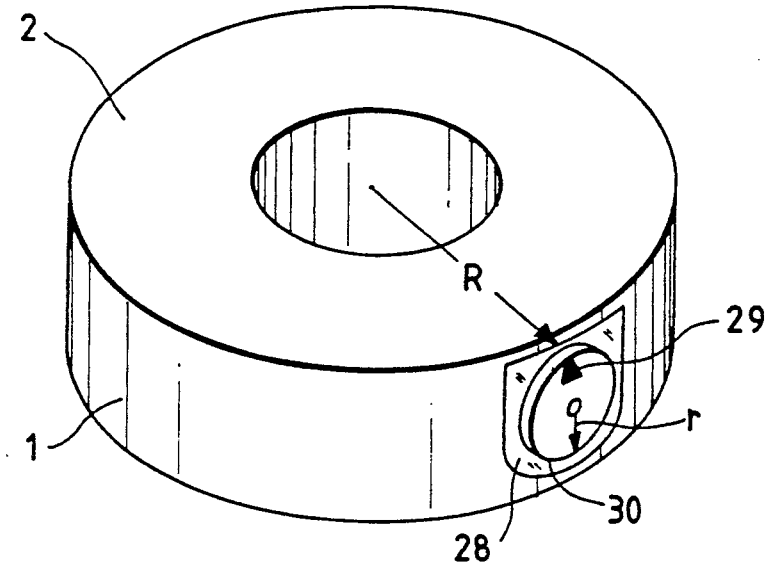
FIG. 9 is a schematic perspective view of the construction of a clock spring in accordance with another embodiment of the present invention.
Figure 2:
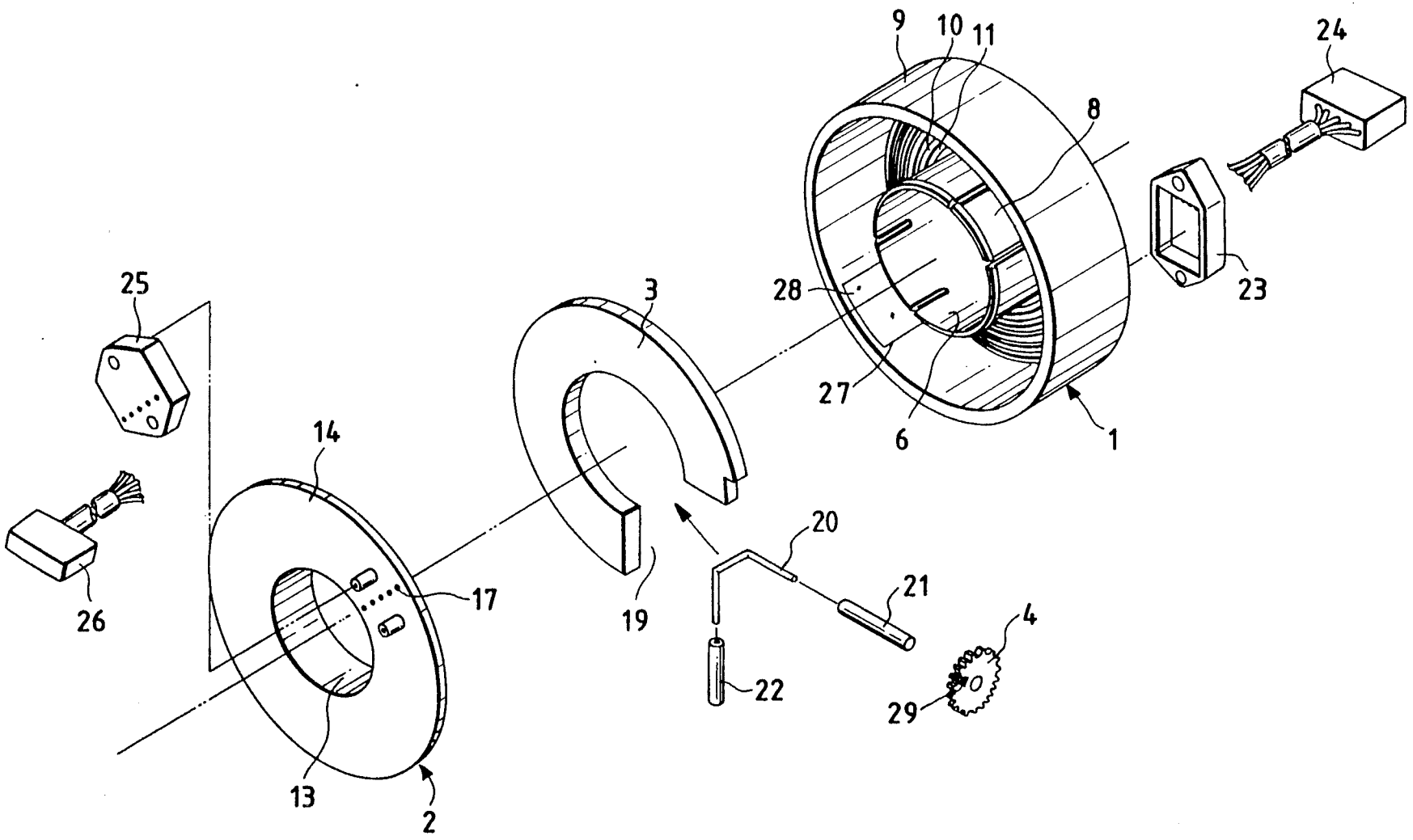
Figure 3:
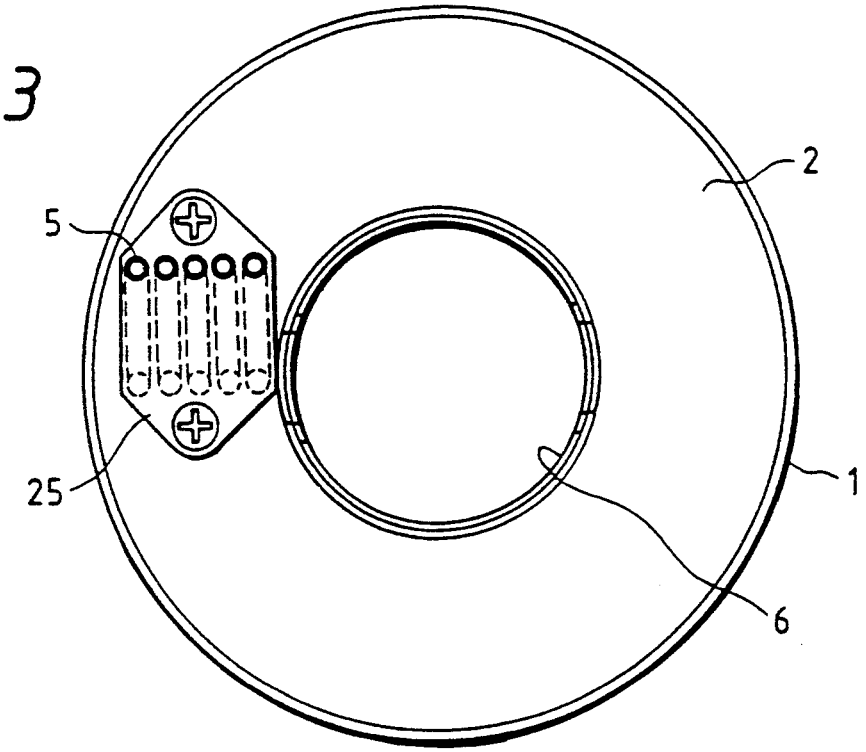

In the above-described embodiment, gear 4 and first and second racks 12 and 18 are used as a means for driving the spacer 3. The arrangement may alternatively be such that, in accordance with another embodiment of the present invention shown in FIG. 9, a roller 30 formed of rubber or the like is axially supported on the spacer 3 and is made to contact and roll on the opposed surfaces of the lower and upper cases 1 and 2. In this case, if the radius of the roller 30 is r; the radius of the locus of rolling of the roller 30 is R; and the number of rotations of the roller 30 during one revolution of the same is n, the relationship therebetween is:

$$2\pi R = n \times 2\pi r \quad (2)$$

For example, if R=55 mm and r=10 mm are substituted in equation (2), n=5.5 is obtained, that is, the roller 30 rotates 5.5 times while making one revolution. Accordingly, in this example, when the clock spring is in the neutral state, a mark 29 provided on the roller 30 faces in the right-above direction, and, if the upper case 2 is rotated two times in the normal or reverse direction from the neutral state, the roller 30 makes one revolution while rotating 5.5 times on its axis and the mark 30 is shifted by 180° to the right-below position.

In each of the above-described embodiments, a transparent cover 28 for observing the gear 4 (or roller 30) with the eye is fitted in the outer peripheral wall 9 of the lower case 1. However, it is possible to eliminate the need for the cover 28 by forming the whole case of a transparent resin.

In the above-described embodiments, five flexible cables 5 and the same numbers of first and second cable accommodation grooves 11 and 16 are used. Needless to say, the selection of this number is not exclusive. Also, it is not always necessary to coil all the plurality of flexible cables in the same direction; the flexible cables can be coiled in opposite directions. In such a case, the spacer can be driven and rotated by the flexible cables, and the gear 4 or the roller 30 can serve as an indicator alone.

In accordance with the present invention, as described above, the necessary length of the cables can remarkably be reduced and the rolling member serving as a positioning indicator can be accommodated inside the movable and stationary members. It is thus possible to provide a clock spring which can suitably be reduced in price and size.

What is claimed is:

1. A clock spring comprising:

a stationary member;

a movable member fitted to said stationary member so as to be rotatable relative to same;

at least one cable having a portion accommodated in a cable housing defined by said stationary and movable members and two end portions respectively fixed to said stationary and movable members and led out of said cable housing, the portion of said cable accommodated in said cable housing including a portion coiled on said stationary member, a portion coiled on said movable member in the direction opposite to the direction of the coiling in said stationary member, and a turned portion connecting the coiled portions; and a rolling member pinched between said stationary and movable members, said rolling member serving as an indicator.

2. A clock spring according to claim 1, wherein said rolling member is formed of a gear, and a ring-like rack capable of meshing with said gear is provided on at least one of said stationary and movable members.

3. A clock spring according to claim 1, wherein said rolling member is formed of a roller.

* * * * *

UNITED STATES PATENT AND TRADEMARK OFFICE

CERTIFICATE OF CORRECTION

PATENT NO. : 5,127,841
DATED : July 7, 1992
INVENTOR(S) : Bannai et al.

It is certified that error appears in the above-identified patent and that said Letters Patent is hereby corrected as shown below:

Title page, item [30] should read as follows:

Foreign Application Priority Data

Jun. 14, 1990 JP Japan 2-62198

Signed and Sealed this

Fourteenth Day of September, 1993

*Attest:*

*Attesting Officer*

BRUCE LEHMAN

*Commissioner of Patents and Trademarks*